US005931767A

United States Patent [19]

Morales

[11] Patent Number: 5,931,767

[45] Date of Patent: Aug. 3, 1999

[54] SHOULDER EXERCISE MACHINE

[76] Inventor: Luis Morales, 23 Prospect St. Apt. #2, Clifton, N.J. 07011

[21] Appl. No.: 08/927,515

[22] Filed: Sep. 11, 1997

[51] Int. Cl.[6] ..... A63B 23/12

[52] U.S. Cl. ..... 482/102; 482/133

[58] Field of Search ..... 482/99, 102, 103, 482/133, 138, 98

[56] References Cited

U.S. PATENT DOCUMENTS

| | | | |
|---|---|---|---|
| 4,635,926 | 1/1987 | Minkow | 482/102 |
| 5,336,153 | 8/1994 | Chen | 482/99 X |
| 5,738,616 | 4/1998 | Robertson | 482/102 |

FOREIGN PATENT DOCUMENTS

| | | | |
|---|---|---|---|
| 3139921 | 4/1987 | Germany | 482/138 |
| 2186806 | 8/1987 | United Kingdom | 482/103 |

*Primary Examiner*—John Mulcahy

[57] ABSTRACT

A new Shoulder Exercise Machine for exercising and developing the shoulder muscles. The inventive device includes a frame assembly, a weight stack mounted in the frame assembly, a base assembly mounted to and extending outward from the frame assembly, a seat and a backrest supported by the base assembly, a pulley system supported by the frame assembly and the base assembly, and a lifting cable coupled to the weight stack and reeved through the pulley system. The seat and the backrest are adapted to support a user positioned in a forward facing direction with his or her back to the frame assembly wherein the user grasps both ends of the lifting cable and raises his or her arms to lift a selected amount of weight from the weight stack and thereby exercise his or her shoulder muscles.

17 Claims, 2 Drawing Sheets

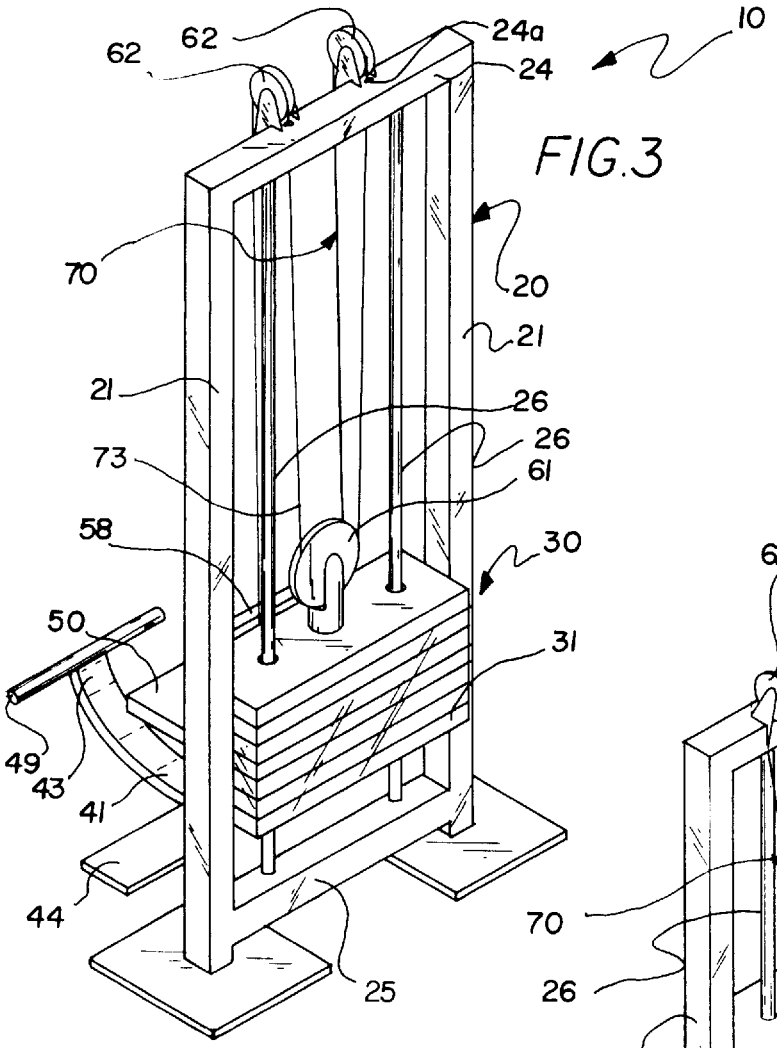
FIG.3
FIG.4
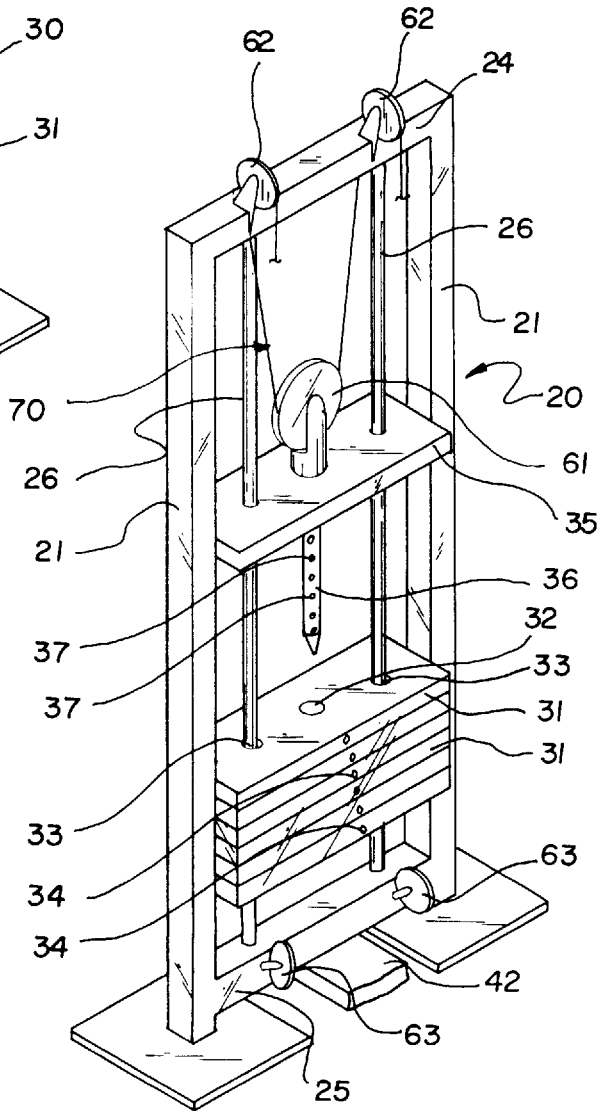

SHOULDER EXERCISE MACHINE

BACKGROUND OF THE INVENTION

1. Field of the Invention

The present invention relates to exercise machines and more particularly pertains to a new Shoulder Exercise Machine for exercising and developing the shoulder muscles.

2. Description of the Prior Art

The use of exercise machines is known in the prior art. More specifically, exercise machines heretofore devised and utilized are known to consist basically of familiar, expected and obvious structural configurations, notwithstanding the myriad of designs encompassed by the crowded prior art which have been developed for the fulfillment of countless objectives and requirements.

Known prior art exercise machines include U.S. Pat. No. 5,419,747; U.S. Pat. No. 5,176,601; U.S. Pat. No. D 348, 495; U.S. Pat. No. 5,171,198; U.S. Pat. No. 4,817,943; and U.S. Pat. No. 5,328,429.

While these devices fulfill their respective, particular objectives and requirements, the aforementioned patents do not disclose a new Shoulder Exercise Machine. The inventive device includes a frame assembly, a weight stack mounted in the frame assembly, a base assembly mounted to and extending outward from the frame assembly, a seat and a backrest supported by the base assembly, a pulley system supported by the frame assembly and the base assembly, and a lifting cable coupled to the weight stack and reeved through the pulley system. The seat and the backrest are adapted to support a user positioned in a forward facing direction with his or her back to the frame assembly wherein the user grasps both ends of the lifting cable and raises his or her arms to lift a selected amount of weight from the weight stack and thereby exercise his or her shoulder muscles.

In these respects, the Shoulder Exercise Machine according to the present invention substantially departs from the conventional concepts and designs of the prior art, and in so doing provides an apparatus primarily developed for the purpose of exercising and developing the shoulder muscles.

SUMMARY OF THE INVENTION

In view of the foregoing disadvantages inherent in the known types of exercise machines now present in the prior art, the present invention provides a new Shoulder Exercise Machine construction wherein the same can be utilized for exercising and developing the shoulder muscles.

The general purpose of the present invention, which will be described subsequently in greater detail, is to provide a new Shoulder Exercise Machine apparatus and method which has many of the advantages of the exercise machines mentioned heretofore and many novel features that result in a new Shoulder Exercise Machine which is not anticipated, rendered obvious, suggested, or even implied by any of the prior art exercise machines, either alone or in any combination thereof.

To attain this, the present invention generally comprises a frame assembly, a weight stack mounted in the frame assembly, a base assembly mounted to and extending outward from the frame assembly, a seat and a backrest supported by the base assembly, a pulley system supported by the frame assembly and the base assembly, and a lifting cable coupled to the weight stack and reeved through the pulley system. The seat and the backrest are adapted to support a user positioned in a forward facing direction with his or her back to the frame assembly wherein the user grasps both ends of the lifting cable and raises his or her arms to lift a selected amount of weight from the weight stack and thereby exercise his or her shoulder muscles.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new Shoulder Exercise Machine apparatus and method which has many of the advantages of the exercise machines mentioned heretofore and many novel features that result in a new Shoulder Exercise Machine which is not anticipated, rendered obvious, suggested, or even implied by any of the prior art exercise machines, either alone or in any combination thereof.

It is another object of the present invention to provide a new Shoulder Exercise Machine which may be easily and efficiently manufactured and marketed.

It is a further object of the present invention to provide a new Shoulder Exercise Machine which is of a durable and reliable construction.

An even further object of the present invention is to provide a new Shoulder Exercise Machine which is susceptible of a low cost of manufacture with regard to both materials and labor, and which accordingly is then susceptible of low prices of sale to the consuming public, thereby making such Shoulder Exercise Machine economically available to the buying public.

Still yet another object of the present invention is to provide a new Shoulder Exercise Machine which provides in the apparatuses and methods of the prior art some of the advantages thereof, while simultaneously overcoming some of the disadvantages normally associated therewith.

Still another object of the present invention is to provide a new Shoulder Exercise Machine for exercising and developing the shoulder muscles.

Yet another object of the present invention is to provide a new Shoulder Exercise Machine which includes a frame assembly, a weight stack mounted in the frame assembly, a base assembly mounted to and extending outward from the frame assembly, a seat and a backrest supported by the base assembly, a pulley system supported by the frame assembly and the base assembly, and a lifting cable coupled to the weight stack and reeved through the pulley system. The seat and the backrest are adapted to support a user positioned in a forward facing direction with his or her back to the frame assembly wherein the user grasps both ends of the lifting cable and raises his or her arms to lift a selected amount of weight from the weight stack and thereby exercise his or her shoulder muscles.

Still yet another object of the present invention is to provide a new Shoulder Exercise Machine that would allow a user to isolate the shoulder muscles for maximum development.

Even still another object of the present invention is to provide a new Shoulder Exercise Machine that could be used by individuals of various strength abilities.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a rear isometric illustration of the present invention.

FIG. 4 is a front isometric illustration of the frame assembly and the weight stack of the present invention.

DESCRIPTION OF THE PREFERRED EMBODIMENT

Figures 1, 2:
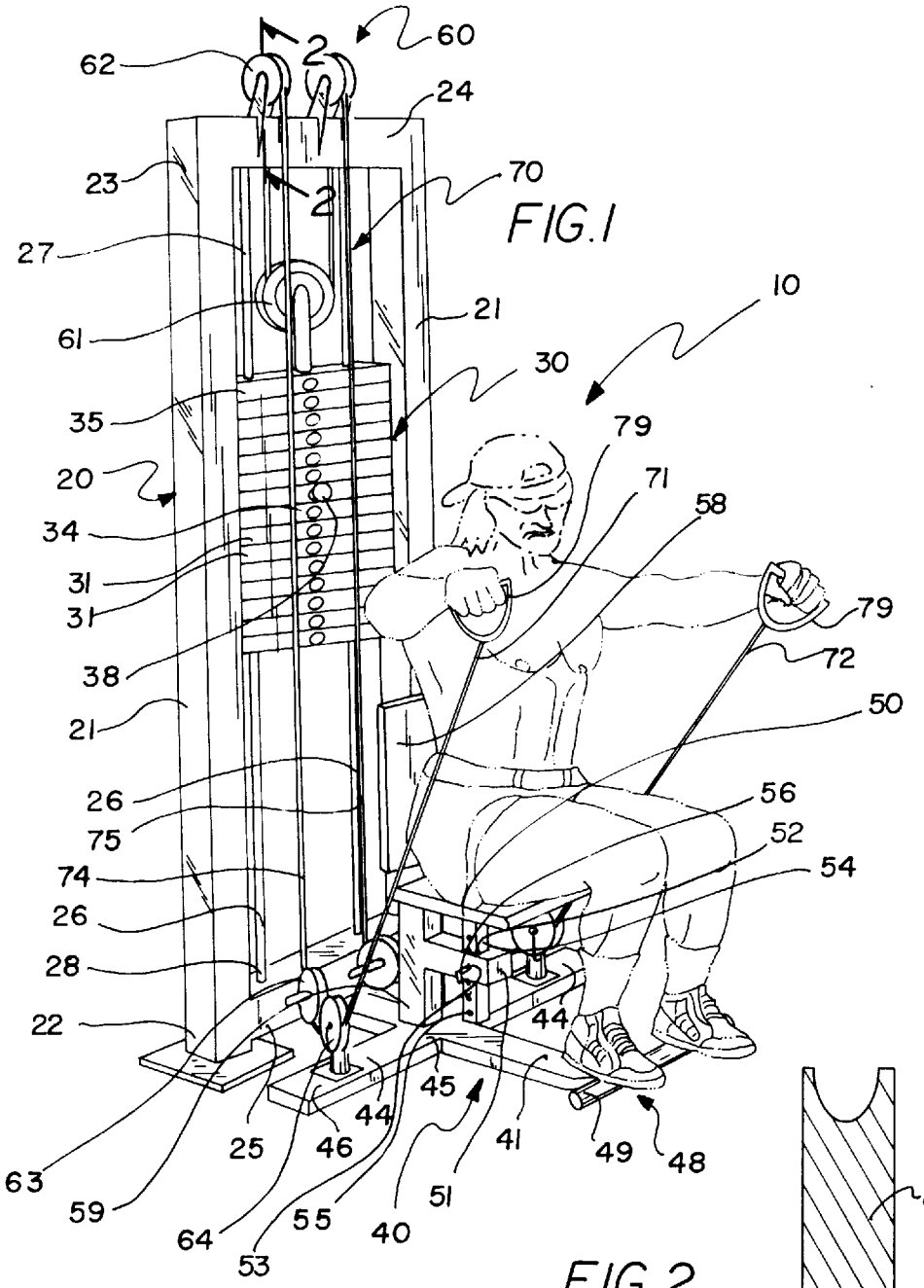
FIG. 1 is a front isometric illustration of a new Shoulder Exercise Machine according to the present invention.
FIG. 2 is a cross sectional view taken along line 2—2 of FIG. 1.

With reference now to the drawings, and in particular to FIGS. 1 through 4 thereof, a new Shoulder Exercise Machine embodying the principles and concepts of the present invention and generally designated by the reference numeral 10 will be described.

As best illustrated in FIGS. 1 through 4, the Shoulder Exercise Machine 10 comprises a frame assembly 20, a weight stack 30 mounted in the frame assembly 20, a base assembly 40 mounted to and extending outward from the frame assembly 20, a seat 50 and a backrest 58 supported by the base assembly 40, a pulley system 60 supported by the frame assembly 20 and the base assembly 40, and a lifting cable 70 coupled to the weight stack 30 and reeved through the pulley system 60. The seat 50 and the backrest 58 are adapted to support a user positioned in a forward facing direction with his or her back to the frame assembly 20 wherein the user grasps both ends of the lifting cable 70 and raises his or her arms to lift a selected amount of weight from the weight stack 30 and thereby exercise his or her shoulder muscles.

The frame assembly 20 includes a pair of vertical frame members 21, an upper cross member 24, and a lower cross member 25. Each of the vertical frame members 21 have a lower end 22 resting on an underlying surface and an upper end 23. As such, the upper cross member 24 interconnects the upper ends 23 of the vertical frame members 21 and the lower cross member 25 interconnects the lower ends 22 of the vertical frame members 21. The frame assembly 20 also includes a pair of vertical guide rods 26 extending between the upper cross member 24 and the lower cross member 25. Each of the vertical guide rods 26 have an upper end 27 and a lower end 28 wherein the upper ends 27 thereof are secured to the upper cross member 24 and the lower ends 28 thereof are secured to the lower cross member 25.

The weight stack 30 includes a plurality of weight plates 31 including a top plate 35, a selector rod 36 depending from the top plate 35 and extending through the weight plates 31, and a coupling pin 38 for coupling a selected number of the weight plates 31 to the selector rod 36. The weight plates 31 are vertically stacked upon each other and have a selector-rod hole 32 therethrough through which the selector rod 36 extends. In addition, each of the weight plates 31 have a pair of guide holes 33 therethrough through which the vertical guide rods 26 extend. As such, the weight plates 31 are vertically and slidably mounted on the vertical guide rods 26. Furthermore, each of the weight plates 31 have a coupling hole 34 through the face thereof. Accordingly, the selector rod 36 has a plurality of selector holes 37 therethrough each corresponding to one of the weight plates 31 wherein the user may select the amount of weight to be lifted by inserting the coupling pin 38 through the coupling hole 34 of a selected weight plate and into a corresponding one of the selector holes 37 provided in the selector rod 36. In an illustrative embodiment, the weight of each of the weight plates 31 is about 2.5 pounds.

The base assembly 40 rests on the underlying surface and includes a base member 41 extending outward from the frame assembly 20 and a pair of side members 44 each projecting from opposite sides of the base member 41. The base member 41 has a first end 42 and a second end 43 and each of the side members 44 have an inner end 45 and an outer end 46. Accordingly, the first end 42 of the base member 41 is secured to the frame assembly 20 such that the base member 41 perpendicularly extends from and is aligned with a midplane of the frame assembly 20. The inner ends 45 of the side members 44 are secured to the base member 41 intermediate the first end 42 and the second end 43 thereof such that side members 44 perpendicularly project from the base member 41 and are offset from the frame assembly 20.

In an illustrative embodiment, the backrest 58 is supported by a first support member 59 extending upward from the base member 40 and the seat 50 is supported by a second support member 51 perpendicularly extending outward from the first support member 59. Accordingly, the seat 50 and the backrest 58 are aligned with the midplane of the frame assembly 20. In a preferred embodiment, the seat 50 is height adjustable. As such, a vertical adjustment member 54 having a plurality of adjustment holes 55 therethrough is mounted to an underside of the seat 50. Accordingly, the vertical adjustment member 54 is slidably fitted within a vertical opening 52 provided in the second support member 51. The vertical adjustment member 54 is retained in a desired position by a retention pin 56 selectively inserted through a horizontal hole 53 provided in the second support member 51 and through one of the plurality of adjustment holes 55 provided in the vertical adjustment member 54.

As best illustrated in FIGS. 1 and 3, a footrest 48 is provided at the second end 43 of the base member 41. In a preferred embodiment, the second end 43 of the base member 41 is curved slightly upward such that footrest 48 is positioned slightly above the underlying surface. In a preferred embodiment, the footrest 48 comprises an elongated bar 49 perpendicularly secured to the second end 43 of the base member 41.

As best illustrated in FIGS. 1 through 4, the pulley system 60 comprises a weight stack pulley 61 mounted on the top plate 35 of the weight plates 31, a pair of upper pulleys 62 mounted on the upper cross member 24 of the frame assembly 20, a pair of lower pulleys 63 mounted on the lower cross member 25 of the frame assembly 20, and a pair of side pulleys 64 each mounted on one of the side members 44 of the base assembly 40. The weight stack pulley 61 is oriented and rotates in a plane generally perpendicular to the midplane of the frame assembly 20. The upper pulleys 62 are mounted on the upper cross member 24 in a spaced-apart parallel relationship and are oriented and rotate in a plane parallel to the midplane of the frame assembly 20. The lower pulleys 63 are mounted on the lower cross member 25 in a spaced-apart relationship in alignment with the upper pulleys 62. In a preferred embodiment, the lower pulleys 63 are oriented at an acute angle to a plane parallel to the midplane of the frame assembly 20. In addition, the side pulleys 64 are pivotally mounted on the side members 44 in alignment with the lower pulleys 63.

The lifting cable 70 has a first end 71 and a second end 72. As such, the lifting cable 70 includes a mid-section 73 intermediate the first end 71 and the second end 72, a first-half section 74 extending between the mid-section 73 and the first end 71, and a second-half section 75 extending between the mid-section 73 and the second end 72. Accordingly, the mid-section 73 of the lifting cable 70 is reeved through the weight stack pulley 61, the first-half section 74 is reeved through one of the upper pulleys 62, one of the lower pulleys 63, and one of the side pulleys 64, and the second-half section 75 is reeved through the other upper pulley 62, the other lower pulley 63, and the other side pulley 64. In an illustrative embodiment, the upper cross member 24 has a pair of cables holes 24*a* vertically therethrough through which the first-half section 74 and the second-half section 75 of the lifting cable 70 pass.

In a preferred embodiment, a pair of stirrup handle assemblies 79 are provided wherein one of the stirrup handle assemblies is coupled to the first end 71 of the lifting cable 70 and the other stirrup handle assembly is coupled to the second end 72 of the lifting cable 70.

In use, a user sits in the seat 50 in a forward facing direction with his or her back to the frame assembly 20. To isolate and exercise the various shoulder muscles, the user sits in the seat 50, grasps the stirrup handle assemblies 79, and raises their arms in various arrangements. In a first arrangement, for example, the user sits in an upright position with his or her back against the backrest 58, grasps the stirrup handle assemblies 79 with their palms facing down, and simultaneously raises their arms laterally and upward above their shoulders. In a second arrangement the user sits in an upright position with his or her back against the backrest 58, grasps the stirrup handle assemblies 79 with their palms facing down, and simultaneously raises their arms forward and upward above their shoulders. In a third arrangement the user sits in an upright position with his or her back against the backrest 58, grasps the stirrup handle assemblies 79 with their palms facing up, and simultaneously raises their arms forward and upward above their shoulders. Furthermore, in a fourth arrangement the user sits in a bent position with their back oriented at an angle to the backrest 58, grasps the stirrup handle assemblies 79 with their palms facing down, and simultaneously raises their arms laterally and upward above their shoulders. Accordingly, with the Shoulder Exercise Machine 10 the user may easily isolate and exercise the various shoulder muscles for maximum development.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A shoulder exercise machine comprising:

a frame assembly;

a weight stack hoistably mounted in said frame assembly;

a base assembly mounted to and extending outward from said frame assembly, including a base member extending outward from said frame assembly, and a pair of side members each projecting from opposite sides of said base member;

a seat and upright backrest supported by said base assembly;

a pulley system supported by said frame assembly and said base assembly, said pulley system including a weight stack pulley mounted to said weight stack, a pair of upper pulleys mounted on an upper portion of said frame assembly, a pair of lower pulleys mounted on a lower portion of said frame assembly and oriented at an acute angle to a midplane of said frame assembly and a pair of side pulleys each mounted on one of said pair of side members of said base assembly;

a lifting cable reeved through said pulley system such that pulling on opposite ends of said lifting cable lifts said weight stack;

said seat and backrest adapted to support a user positioned in a forward facing direction with his or her back to said frame assembly, whereby a user may grasp both ends of said lifting cable and raise their arms to lift a selected amount of weight from said weight stack and thereby exercise their shoulder muscles; and said side pulleys being positioned in front of said backrest and on either side of said seat such that the spine of a user seated against the front of said backrest lies substantially in the same plane as said side pulleys for producing a neutral rotation when exercising the shoulder muscles.

2. The shoulder exercise machine of claim 1, wherein said frame assembly comprises:

a pair of vertical frame members, an upper cross member interconnecting said pair of vertical frame members at an upper end thereof, a lower cross member interconnecting said pair of vertical frame members at a lower end thereof, and a pair of vertical guide rods extending between said upper cross member and said lower cross member.

3. The shoulder exercise machine of claim 2, wherein said weight stack comprises:

a plurality of weight plates vertically and slidably mounted on said pair of vertical guide rods, a selector rod depending from a top plate of said plurality of weight plates and extending through said plurality of weight plates, and a coupling means for coupling a selected number of said plurality of weight plates to said selector rod.

4. The shoulder exercise machine of claim 1, further comprising:

a footrest provided at an outermost end of said base member.

5. The shoulder exercise machine of claim 1, wherein a mid-section of said lifting cable is reeved through said weight stack pulley, wherein a first-half section of said lifting cable is reeved from said weight stack pulley through a first of said pair of upper pulleys, a first of said pair of lower pulleys, and a first of said pair of side pulleys, and wherein a second-half section of said lifting cable is reeved from said weight stack pulley through a second of said pair of upper pulleys, a second of said pair of lower pulleys, and a second of said pair of side pulleys.

6. The shoulder exercise machine of claim 1, further comprising:

a pair of stirrup handle assemblies, one of said pair of stirrup handle assemblies coupled to a first end of said lifting cable and another of said pair of stirrup handle assemblies coupled to a second end of said lifting cable.

7. A shoulder exercise machine, comprising:

a frame assembly including a pair of vertical frame members, an upper cross member interconnecting said pair of vertical frame members at an upper end thereof, a lower cross member interconnecting said pair of vertical frame members at a lower end thereof, and a pair of vertical guide rods extending between said upper cross member and said lower cross member;

a weight stack including a plurality of weight plates vertically and slidably mounted on said pair of vertical guide rods, a selector rod depending from a top plate of said plurality of weight plates and extending through said plurality of weight plates, and a coupling means for coupling a selected number of said plurality of weight plates to said selector rod;

a base assembly including a base member extending outward from said frame assembly and a pair of side members each projecting from opposite sides of said base member, each of said side members being positioned substantially perpendicular to said base member;

a seat and backrest supported above said base assembly, said seat and upright backrest being adapted to support a user positioned in a forward facing direction with his or her back to said frame assembly;

a pulley system including a weight stack pulley mounted on said top plate of said plurality of weight plates, a pair of upper pulleys mounted on said upper cross member of said frame assembly, a pair of lower pulleys mounted on said lower cross member of said frame assembly and oriented at an acute angle to a midplane of said frame assembly, and a pair of side pulleys each mounted on one of said pair of side members of said base assembly, said side pulleys being positioned in front of said backrest and on either side of said seat such that the spine of a user seated against the front of said backrest lies substantially in the same plane as said side pulleys for producing a neutral rotation when exercising the shoulder muscles; and a lifting cable including a mid-section, a first-half section, and a second-half section, said mid-section reeved through said weight stack pulley, said first-half section reeved through a first of said pair of upper pulleys, a first of said pair of lower pulleys, and a first of said pair of side pulleys, and said second-half section reeved through a second of said pair of upper pulleys, a second of said pair of lower pulleys, and a second of said pair of side pulleys.

8. The shoulder exercise machine of claim 7, wherein each of said plurality of weight plates have a coupling hole in the face thereof, wherein said selector rod has a plurality of selector holes therethrough each corresponding to one of said plurality of weight plates, and wherein said coupling means comprises:

a coupling pin selectively insertable through said coupling hole of a selected weight plate and into a corresponding one of said plurality of selector holes provided in said selector rod.

9. The shoulder exercise machine of claim 7, wherein said weight stack pulley is oriented and rotates in a plane generally perpendicular to a midplane of said frame assembly, wherein said pair of upper pulleys are mounted on said upper cross member in a spaced-apart parallel relationship and are oriented and rotate in a plane parallel to said midplane of said frame assembly, wherein said pair of lower pulleys are mounted on said lower cross member in a spaced-apart relationship in alignment with said pair of upper pulleys, and wherein said pair of side pulleys are mounted on said pair of side members in alignment with said pair of lower pulleys.

10. The shoulder exercise machine of claim 7, further comprising:

a footrest provided at an outermost end of said base member.

11. The shoulder exercise machine of claim 7, further comprising:

a pair of stirrup handle assemblies, one of said pair of stirrup handle assemblies coupled to a first end of said lifting cable and another of said pair of stirrup handle assemblies coupled to a second end of said lifting cable.

12. The shoulder exercise machine of claim 7, further comprising a first support member being extended upwardly from said base member, a second support member being perpendicularly extended outwardly from said first support member in a direction away from said frame assembly, said seat being coupled to said second support member such that it is supported above said base assembly, a backrest being mounted to said first support member, said seat and backrest being adapted to support a user positioned in a forward facing direction with his or her back to said frame assembly.

13. A shoulder exercise machine, comprising:

a frame assembly including a pair of vertical frame members each having an upper end and a lower end, an upper cross member interconnecting said upper end of each of said pair of vertical frame members, a lower cross member interconnecting said lower end of each of said pair of vertical frame members, and a pair of vertical guide rods each having an upper end secured to said upper cross member and a lower end secured to said lower cross member;

a weight stack including a plurality of weight plates vertically and slidably mounted on said pair of vertical guide rods, a selector rod depending from a top plate of said plurality of weight plates and extending through said plurality of weight plates, and a coupling means for coupling a selected number of said plurality of weight plates to said selector rod;

a base assembly including a base member having a first end secured to said frame assembly and a second end, and a pair of side members each having an inner end secured to said base member intermediate said first end and said second end thereof, wherein said base member perpendicularly extends from and is aligned with a midplane of said frame assembly and wherein said pair of side members perpendicularly project from opposite sides of said base member and are offset from said frame assembly, each of said side members being positioned substantially perpendicular to said base member;

a first support member being extended upwardly from said base member, a second support member being perpendicularly extended outwardly from said first support member in a direction away from said frame assembly;

a seat and upright backrest, said seat being coupled to said second support member such that it is supported above said base assembly, said backrest being mounted to said first support member, said seat and backrest being adapted to support a user positioned in a forward facing direction with his or her back to said frame assembly;

a pulley system including a weight stack pulley mounted on said top plate of said plurality of weight plates, a pair of upper pulleys mounted on said upper cross member of said frame assembly in a spaced-apart parallel relationship, a pair of lower pulleys mounted on said lower cross member of said frame assembly in alignment with said pair of upper pulleys and oriented at an acute angle to a midplane of said frame assembly, and a pair of side pulleys each mounted on one of said pair of side members of said base assembly in alignment with one of said pair of lower pulleys;

said weight stack pulley oriented and rotating in a plane generally perpendicular to said midplane of said frame assembly, said pair of upper pulleys oriented and rotating in a plane generally parallel to said midplane of said frame assembly;

said side pulleys being positioned in front of said backrest and on either side of said seat such that the spine of a user seated against the front of said backrest lies substantially in the same plane as said side pulleys for producing a neutral rotation when exercising the shoulder muscles;

a lifting cable having a first end and a second end, and including a mid-section, a first-half section, and a second-half section, said mid-section of said lifting cable reeved through said weight stack pulley, said first-half section of said lifting cable reeved through a first of said pair of upper pulleys, a first of said pair of lower pulleys, and a first of said pair of side pulleys, said second-half section of said lifting cable reeved through a second of said pair of upper pulleys, a second of said pair of lower pulleys, and a second of said pair of side pulleys; and a pair of stirrup handle assemblies, one of said pair of stirrup handle assemblies coupled to said first end of said lifting cable and another of said pair of stirrup handle assemblies coupled to said second end of said lifting cable.

14. The shoulder exercise machine of claim 12, wherein each of said plurality of weight plates have a coupling hole in the face thereof, wherein said selector rod has a plurality of selector holes therethrough each corresponding to one of said plurality of weight plates, and wherein said coupling means comprises:

a coupling pin, whereby a user may select an amount of weight to be lifted by inserting said coupling pin through said coupling hole of a selected weight plate and into a corresponding one of said plurality of selector holes provided in said selector rod.

15. The shoulder exercise machine of claim 12, wherein said seat is height adjustable.

16. The shoulder exercise machine of claim 12, further comprising:

a footrest provided at said second end of said base member.

17. The shoulder exercise machine of claim 16, wherein said footrest comprises:

an elongated bar perpendicularly secured to said second end of said base member.

* * * * *